United States Patent [19]

Mullendore

[11] Patent Number: 4,784,690

[45] Date of Patent: Nov. 15, 1988

[54] LOW DENSITY TUNGSTEN ALLOY ARTICLE AND METHOD FOR PRODUCING SAME

[75] Inventor: James A. Mullendore, Towanda, Pa.

[73] Assignee: GTE Products Corporation, Stamford, Conn.

[21] Appl. No.: 786,457

[22] Filed: Oct. 11, 1985

[51] Int. Cl.[4] ..... C22C 1/04

[52] U.S. Cl. ..... 75/248; 419/28; 419/29; 419/53; 419/54; 419/55; 419/38; 419/58; 420/430; 420/432

[58] Field of Search ..... 75/248; 419/28, 29, 419/38, 58, 53, 54, 55; 420/430, 432

[56] References Cited

U.S. PATENT DOCUMENTS 2,843,921 7/1958 Ang ..... 75/248

*Primary Examiner*—Stephen J. Lechert, Jr.

*Attorney, Agent, or Firm*—Donald R. Castle; L. Rita Quatrini

[57] ABSTRACT

A low density tungsten alloy article is disclosed and the method for producing the article. The method involves compacting a relatively uniform tungsten alloy powder with the tungsten content comprising no greater than about 90% by weight of the alloy and the balance a matrix phase to produce a preformed article which is then sintered in a reducing atmosphere at a temperature below the melting point of the matrix phase for a sufficient time to form a densified article which is mechanically worked to produce the final article.

6 Claims, 1 Drawing Sheet

LOW DENSITY TUNGSTEN ALLOY ARTICLE AND METHOD FOR PRODUCING SAME

BACKGROUND OF THE INVENTION

For armor penetrating kinetic energy penetrators, it is usually desirable to have as high a density as possible. For that reason, tungsten alloys are normally used having at least 90% tungsten, the balance being from the elements nickel, iron, copper, and cobalt. The densities of these alloys range from about 17.1 g/cc for a 90% tungsten alloy to about 18.7 g/cc for a 98% tungsten alloy.

However, there are certain applications in which a high density is not desirable, that is, in which a high density alloy results in a penetrator having too large a weight to function properly with the gun system being used. For those applications, it is desirable to have a series of alloys having densities below about 17.1 g/cc.

In addition, the material must also be capable of being worked so that a high hardness can be obtained which permits the penetrator to defeatthe intended targets.

SUMMARY OF THE INVENTION

In accordance with one aspect of this invention there is provided a low density tungsten alloy article.

In accordance with another aspect of this invention, there is provided a method for producing the above low density tungsten alloy article. The method involves compacting a relatively uniform tungsten alloy powder with the tungsten content comprising no greater than about 90% by weight of the alloy and the balance a matrix phase to produce a preformed article which is ten sintered in a reducing atmosphere at a temperature below the melting point of the matrix phase for a sufficient time to form a densified article which is mechanically worked to produce the final article.

DETAILED DESCRIPTION OF THE INVENTION

Figure 1:
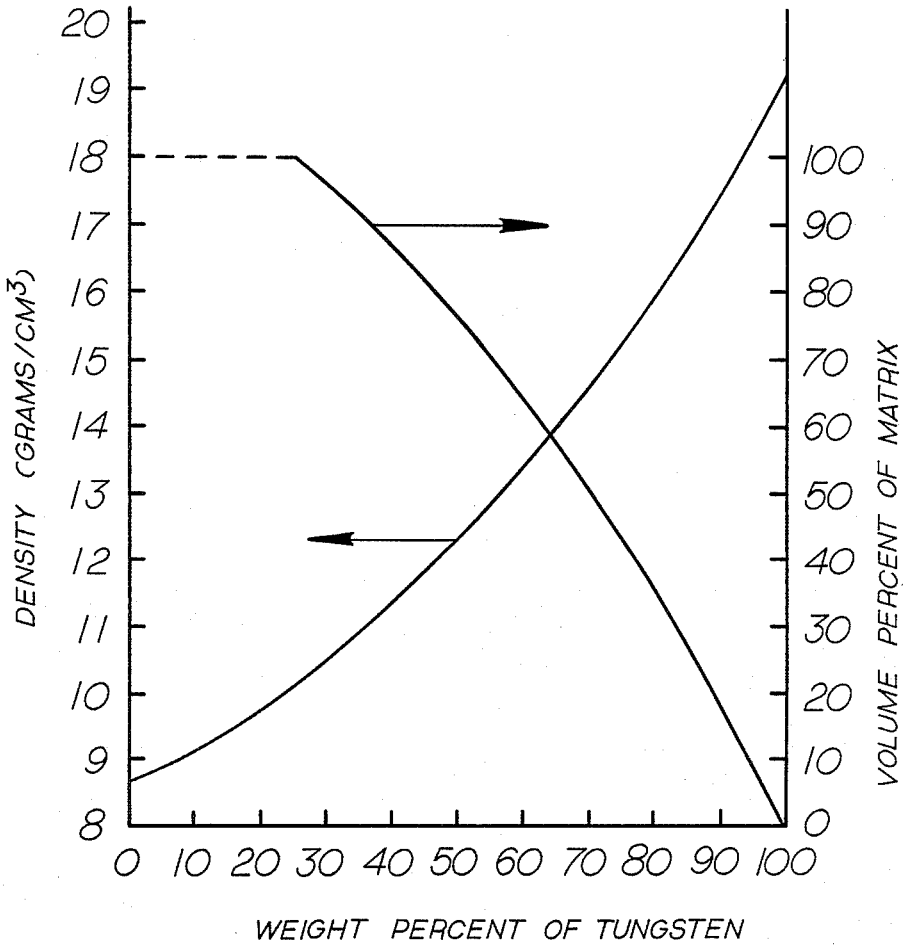
FIG. 1 is a plot of the effect of the weight percent tungsten on the density and the volume percent matrix phase for a series of tungsten-nickel-iron alloys in which the nickel to iron ratio is about 7 to 3.

For a better understanding of the present invention, together with other and further objects, advantages, and capabilities thereof, reference is made to the following disclosure and appended claims in connection with the above described drawing and description of some of the aspects of the invention.

The low density tungsten alloy article of this invention is preferably an armor penetrating kinetic energy penetrator.

The tungsten alloy powder used in the practice of this invention contains no greater than about 90% by weight tungsten and the balance, or, more specifically the matrix phase contains an element or elements which can be iron, nickel, copper, cobalt, rhenium, ruthenium, and combinations thereof. The balance or matrix phase of the alloy is preferably nickel and iron with the weight ratio of nickel to iron being preferably from about 4 to 1 to about 1 to 1, and most preferably about 7 to 3.

The density of the tungsten heavy alloy is directly proportional to the tungsten content. FIG. 1 is a plot of the effect of the weight percent tungsten on the density and on the volume percent matrix for a series of tungsten-nickel-iron alloys in which the nickel to iron ratio is about 7 to 3. For a 90% by weight tungsten alloy, which is the lower limit for most tungsten heavy alloys, the matrix volume percent is about 22%. Preformed articles made from these alloys are normally sintered by a technique known as liquid phase sintering, that is, at a temperature over the melting point of the matrix. For tungsten contents lower than about 90% by weight, the alloy becomes difficult to liquid phase sinter because the large volume of liquid phase present causes the article to slump severely. Furthermore there is a tendency for the tungsten particles in the article to segregate due to the force of gravity which results in a nonuniform tungsten-matrix structure in the article. One way to overcome these problems is to solid state sinter, that is, to sinter at a temperature below the melting point of the matrix phase. Since no liquid phase is present, slumping does not occur nor does gravity segregation occur.

The problem that then occurs is that for tungsten contents over about 75% by weight tungsten, the tungsten forms a continuous phase as opposed to discreet particles that form from liquid phase sintering. The presence of the continuous tungsten phase results in the material being very brittle and difficult to work by conventional means. Therefore the preferred tungsten content according to this invention is less than about 75% by weight. The resulting sintered articles have discreet tungsten particles and are very amenable to working.

The lower limit of the tungsten content is based on the practical requirements for density. Thus a lower density requirement of about 11 g/cc corresponds to a tungsten content of about 40% by weight. Thus, the preferred range of tungsten content is from about 40% to about 70% by weight.

The tungsten alloy powder is preferably blended by conventional techniques to insure uniformity.

The alloy powder is then compacted to produce a preformed article. This is done by any conventional method, but is done preferably by isostatic pressing, with the preferred shape of the article being bars.

The preformed article is then sintered in a reducing atmosphere, preferably dry hydrogen at a temperature below the melting point of the matrix phase for a sufficient time to form a densified article. The sintering is done preferably in two operations. The first operation is done to remove any oxygen which might be contained in the preformed article. For example, in an alloy having a tungsten content of from about 40% to about 70% by weight and having a matrix consisting essentially of nickel and iron in a weight ratio of nickel to iron of about 7 to 3, the first operation is done preferably at from about 900° C. to about 1100° C. and the second operation is done at from about 1200° C. to about 1400° C. The sintering time depends on the temperature and generally on the size of the article.

The structure of the resulting sintered densified article consists essentially of tungsten particles in the matrix. Some porosity is present.

At this point, if the matrix phase consists essentially of nickel and iron in a weight ratio of nickel to iron of greater than about 1, the densified article is heat treated in an inert atmosphere, preferably vacuum, at a sufficient temperature, which is preferably about 1300° C. for a sufficient time to remove remove residual gases such as hydrogen. It has been found that with this type of material, the heat treating increases the ductility of the final article. The heat treating time depends on the size of the article with larger articles requiring longer times.

The densified article is then mechanically worked to produce the final article. The preferred method of mechanically working the heat-treated article is by swaging through dies, preferably at least three dies, which results in a reduction in area of the article which is typically greater than about 50%. The mechanical working increases the strength and hardness significantly, and the resulting final article functions satisfactorily as a penetrator.

To more fully illustrate this invention, the following nonlimiting example is presented.

Example

Elemental powders of tungsten, nickel, and iron are blended to produce a blend consisting essentially of in percent by weight about 60% tungsten, about 28% nickel, and about 12% iron. The theoretical density of this blend is about 12.85 g/cc. The resulting blend is pressed isostatically into bars. The bars are first sintered at about 1100° C. in dry hydrogen and then sintered at about 1400° C. in dry hydrogen. The density after sintering is about 12.66 g/cc. The sintered bars are then heat treated in vacuum at about 1300° C. for about 3 hours. They are then swaged through three dies for a total reduction in area of about 50%. The table below shows the tensile properties and hardness before and after working. As seen, the swaging has increased the strength and hardness significantly. The resulting articles work very well as penetrators.

TABLE

| | Y.S. (KSI) | UTS (KSI) | Elongation (%) | Hardness (HRC) |
|---|---|---|---|---|
| Before Working | 66.5 | 125.5 | 49 | 21.9 |
| After | 166.2 | 177.6 | 8 | 39.2 |

TABLE-continued

| | Y.S. (KSI) | UTS (KSI) | Elongation (%) | Hardness (HRC) |
|---|---|---|---|---|
| Working | | | | |

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for producing a low density tungsten alloy article, said method comprising:

(a) compacting a relatively uniform tungsten alloy powder with the tungsten content comprising no greater than about 90% by weight of said alloy and the balance a matrix phase consisting essentially of iron and nickel in a weight of nickel to iron being from about 4 to 1 to about 1 to 1 to produce a preformed article:

(b) sintering said preformed article in a reducing atmosphere at a temperature below the melting point of said matrix phase for a sufficient time to form a densified article;

(c) mechanically working said densified article to produce the final article.

2. A method of claim 1 wherein said tungsten alloy consists essentially of no greater than about 75% by weight tungsten.

3. A method of claim 2 wherein said tungsten alloy consists essentialy of from about 40% to about 70% by weight tungsten and the balance a matrix phase consisting essentially of a mixture of nickel and iron in a weight ratio of nickel to iron of about 7 to 3.

4. A method of claim 3 wherein said preformed article is sintered at from about 1200° C. to about 1400° C.

5. A method of claim 1 wherein after the sintering step, the densified article having a matrix phase consisting essentially of nickel and iron in a weight ratio of nickel to iron of greater than about 1 is heat treated in an inert atmosphere at a sufficient temperature for a sufficient time to remove residual gases.

6. An article produced by the method of claim 1.

* * * * *